US011339546B2

(12) United States Patent
Bigata et al.

(10) Patent No.: US 11,339,546 B2
(45) **Date of Patent: *May 24, 2022**

(54) ABSORPTION, SIGNALING AND PICKING UP OF A POTENTIALLY HAZARDOUS PRODUCT

(71) Applicant: Hg3 S.à.r.l., Luxembourg (LU)

(72) Inventors: Eric Bigata, Mios (FR); Joël Blomet, Valmondois (DE)

(73) Assignee: Hg3 S.à.r.l., Luxembourg (LU)

( * ) Notice: Subject to any disclaimer, the term of this patent is extended or adjusted under 35 U.S.C. 154(b) by 426 days.

This patent is subject to a terminal disclaimer.

(21) Appl. No.: 16/347,292

(22) PCT Filed: Oct. 31, 2017

(86) PCT No.: PCT/EP2017/077917
§ 371 (c)(1),
(2) Date: May 3, 2019

(87) PCT Pub. No.: WO2018/083100
PCT Pub. Date: May 11, 2018

(65) Prior Publication Data

US 2019/0284772 A1 Sep. 19, 2019

(30) Foreign Application Priority Data

Nov. 4, 2016 (FR) ..... 1660674

(51) Int. Cl.
*E01F 9/688* (2016.01)
*E01F 9/654* (2016.01)
(Continued)

(52) U.S. Cl.
CPC ..... *E01F 9/688* (2016.02); *E01F 9/654* (2016.02); *B08B 1/001* (2013.01); *G09F 15/0087* (2013.01)

(58) Field of Classification Search
CPC ..... E01F 9/688; E01F 9/654; B08B 1/001; G09F 15/0087
See application file for complete search history.

(56) References Cited

U.S. PATENT DOCUMENTS 3,765,044 A * 10/1973 Hanahan ..... B65D 5/0254 15/104.8
4,917,238 A * 4/1990 Schumacher ..... A47L 13/51 206/223

(Continued)

FOREIGN PATENT DOCUMENTS

CH 643314 A5 * 5/1984 ..... E01H 1/001
EP 0931735 A1 * 7/1999 ..... B65F 1/10

(Continued)

OTHER PUBLICATIONS

International Search Report dated Feb. 12, 2018 in corresponding International Application No. PCT/EP2017/077917; 4 pages.

*Primary Examiner* — Nimeshkumar D Patel
*Assistant Examiner* — Tania Courson
(74) *Attorney, Agent, or Firm* — Maier & Maier, PLLC

(57) ABSTRACT

A device for absorbing, signaling and picking up a product on a floor, the device including: a slender hollow body whose inner walls define a storage volume in which is stored a powder able to absorb the product, where the storage volume opens through an opening for pouring the powder by gravity; a stand on which one end of the body is mounted for forming a signaling marker, where the stand includes a substantially flat base projecting radially relative to the body in order to place the device stably on the floor; and wherein the base includes at least two detachable parts which can be used for picking up a residue formed by the powder and the product.

10 Claims, 5 Drawing Sheets

(51) Int. Cl.
*B08B 1/00* (2006.01)
*G09F 15/00* (2006.01)

(56) References Cited

U.S. PATENT DOCUMENTS

| | | | | |
|---|---|---|---|---|
| 6,938,366 | B2 * | 9/2005 | Bober | A47L 13/00 116/63 R |
| 7,003,908 | B2 * | 2/2006 | Bober | A47L 13/00 116/63 R |
| 7,150,118 | B1 * | 12/2006 | Benton | G09F 15/0062 40/610 |
| 7,731,031 | B1 * | 6/2010 | Weinberger | A47L 25/00 206/576 |
| 7,823,757 | B1 | 11/2010 | Vinson et al. | |
| 8,038,188 | B1 * | 10/2011 | Nolan-Brown | E01H 1/1206 294/1.3 |
| 8,118,159 | B2 * | 2/2012 | Gonzalez | B09B 3/0075 206/223 |
| 9,004,555 | B1 * | 4/2015 | Chirico | E01H 1/1206 294/1.3 |
| 10,323,371 | B2 * | 6/2019 | Bigata | E01C 19/2005 |
| 2004/0231214 | A1 | 11/2004 | Bober et al. | |
| 2015/0224352 | A1 * | 8/2015 | Klaffmo | A62D 1/005 252/2 |
| 2019/0120727 | A1 * | 4/2019 | Harding | G01N 21/77 |
| 2019/0210075 | A1 * | 7/2019 | Smith | B08B 3/10 |

FOREIGN PATENT DOCUMENTS

| | | | | |
|---|---|---|---|---|
| GB | 2 124 280 | A | 2/1984 | |
| WO | WO-2016102226 | A1 * | 6/2016 | E01C 19/2005 |

* cited by examiner

ABSORPTION, SIGNALING AND PICKING UP OF A POTENTIALLY HAZARDOUS PRODUCT

FIELD

The present invention relates to the field of hazard prevention and in particular prevention of health hazards.

The subject of the present invention thus relates to a device for absorption, possibly neutralization, signaling and picking up of a potentially hazardous product on a floor.

BACKGROUND

In the present invention potentially hazardous product is understood here in the entire present description to mean a product which most generally has the form of a liquid, paste or powder and which could present a hazard for a person; it may for example involve a health hazard if the product is potentially toxic for a person or if the product is corrosive or irritating, in particular during contact for example of the product with skin or eyes or even during inhalation or ingestion of the product. It can also involve a physical or bodily hazard when for example the product in question can lead to a person slipping.

As nonlimiting examples it may involve chemical or organic products or even food or biological products such as for example paint (acrylic or glycerophtalic), wood stain, oil, chemical liquids, for example solvent-based, strong acids, oxidizers, strong bases, strippers, cleaning liquids or powders, detergents, solvents, fertilizers, insecticides, fungicides or even herbicides, etc.

In everyday life or even at work, potentially hazardous products such as those defined above can pose problems for pollution and/or safety at various levels.

For example, a highway accident with a truck transporting toxic or hazardous raw materials can cause environmental pollution and damage on the highway.

In an industrial environment or a laboratory, mishandling a jug containing a toxic or hazardous raw material can cause personal injury or damage to the facilities.

By allowing the absorption, possibly neutralization, signaling and picking up of potentially hazardous products, the present invention finds many advantageous applications in particular in the domain of warehouse stores or even in the industrial domain or in laboratories.

The following can be listed as examples of applications of the invention: absorption, possibly neutralization, signaling and picking up of a potentially hazardous product on the floor of a department of a home improvement or gardening store; in this application, the invention is particularly advantageous for protecting the clientele and the staff from a hazard to both body and health, for example when the product on the floor is a paint, acid or solvent-based chemical product. In fact, it is unfortunately frequent that reactive, corrosive and/or irritating products like hydrochloric acid (for unclogging drains), which are present in the departments of a home-improvement or gardening store, are accidentally spilled on the floor and are the origin of accidents where these accidents are even more bothersome since they most often involve customers.

Other advantageous applications can also be considered in the scope of the invention, such as for example absorption, possibly neutralization, signaling and picking up of a potentially hazardous product on the floor in an industrial environment and in particular in the chemical industry where the employees regularly handle generally corrosive and irritating chemical products, that are more or less aggressive, like for example strong acids and strong bases. In such an environment, these products frequently fall on the floor and staff members accidentally come into contact with these products.

The rapid management of the products spilled on the floor is essential in many situations.

We are more specifically interested the problem of hazard prevention in warehouse stores.

In stores, and especially in stores dedicated to home improvement and/or gardening, a staff member is generally designated to watch over the careful application in the store or in a department of all the rules concerning hazard prevention, where these hazards are those encountered both by the staff and the customers of the store.

This staff member is therefore designated as health and safety manager. It can therefore involve a department head or a store manager, for example.

Conventionally, this prevention involves in particular signage throughout the store for:

Preventing slipping hazards: by using a signaling marker;

Preventing hazards related to potentially toxic products: by using appropriate information signs or floor marking.

In general, it is important that the information intended for customers and staff be clear, precise and understandable by all.

The marking, in the form of information signs, signaling markers, pictograms, must be in place in all identified hazards zones.

It is easily understood that the customer or staff member who has an accident within a store often seeks to invoke the legal liability of the store, especially if all the provisions relating to safety have not been met by the store: very frequently the courts hear complaints for involuntary homicide or injury with a breach of an obligation of safety or prudence as an aggravating condition, or even complaints for endangering others.

This is very bad both for the financial performance of the store which must in particular couple the financial consequences of the accident and for the brand image and reputation of the store.

In order to provide for the safety of the clientele and the staff in the stores, it is known to use preventive markers PM, required in each store and placed immediately after the spill of potentially hazardous product.

Beyond these signaling elements, there are solutions established for absorbing a product on the floor like spreading a powder on the product in question; this calls for the handling of the powder for spreading it on the product, which is impractical if said powder is not stored near the place where the product spilled on the floor is located.

Further the residue formed by the mixture of the product and the powder is generally left there on the floor at least momentarily to allow the user time to find suitable tools for picking the residue. There is a risk that, even though the residue is marked and left in a walking area for example, a passerby could walk on it. Further selecting suitable tools for picking up such a residue is not always easy because that could depend in particular on the chemistry of the residue to be picked up.

SUMMARY

The present invention aims to improve the situation described above.

The present invention aims to remedy the various disadvantages mentioned above by proposing an easy to use and effective solution with which to absorb, signal the presence of a potentially hazardous product on the floor and pick up the residue formed by the powder and the product.

For that purpose, the subject of the present invention relates, according to a first aspect, to a device for absorbing, signaling and picking up a potentially hazardous product on a floor.

Advantageously, the device according to the present invention comprises a slender, hollow body whose inner walls define a storage volume.

In this storage volume, a powder is stored that is capable of absorbing the potentially hazardous product when the powder comes into contact with said product.

One also refers to absorbing powder.

This powder can also be capable of neutralizing the potentially hazardous product.

In this case, one refers to absorbing and neutralizing powder.

Here it is understood that, in this case, the device is a device for absorbing, neutralizing and signaling a potentially hazardous product on a floor.

Advantageously, the storage volume opens through an opening for pouring the powder by gravity on the product.

By covering the product, this powder absorbs it and potentially neutralizes it.

Advantageously, the device according to the present invention further comprises a stand on which one end of the body is directly or indirectly mounted for forming a signaling marker. The end is a lower end of the body when the signaling marker is vertical.

According to the present invention, the stand comprises a substantially flat base projecting radially relative to said body in order to be able to stably place said device on the floor.

By placing the stand on the floor, it signals the presence of the absorbed and possibly neutralized product on the floor which needs to be picked up.

The base comprises at least two detachable parts which can be used for picking up a residue formed by said powder and said product.

Thus, both by the structure thereof and by the configuration thereof the device according to the invention is seen as a simple to use and compact preventive tool.

All that the individual charged with safety needs to do is spread the powder over the potentially hazardous product through the opening, and then to place the base near the product neutralized by the powder, to signal to others the presence of a potential risk. The individual can then use the detachable parts from the base for picking up the residue.

The present invention proposes a single tool with which at the same time to:

Store a product able to absorb and possibly neutralize a potentially hazardous product; and Signal the presence of said product on the floor; and Pick up the residue.

The subject of the present invention thus has the triple function of providing at once the storage of the powdery product (hazardous product absorber and neutralizer), signaling said product on the floor and picking it up.

Preferably, the base of the stand is formed of a polymer.

In another embodiment, the storage volume also contains a bag suitable for receiving the residue formed by said powder and said product.

In another embodiment, the storage volume also contains a pair of gloves.

In one embodiment as in the other, the storage volume therefore contains all the equipment for picking up the residue.

Preferably, the base has a precut at each junction between a detachable part of the base and the base, suited for making the detachment of the detachable part from the base easier.

Preferably, the slender hollow body is substantially cylindrical and the radial extension of the base is greater than the diameter of the cylinder, and advantageously each detachable part has a surface area greater than a third, preferably greater than a quarter of the surface area of the base.

In a particularly advantageous embodiment, the base has a substantially square shape and advantageously each detachable part has a substantially triangular shape.

In a similar way, the subject matter of the present invention according to a second aspect relates to a method for absorption, neutralization, signaling and picking up a potentially hazardous product on a floor using a device such as described above.

Advantageously the method comprises the steps of pouring a powder by gravity through an opening of a slender hollow body whose inner walls define a storage volume in which is stored this powder able to absorb said product when said powder enters into contact with said product. The method also comprises a step of signaling of said product, using the signaling marker formed by a stand on which the lower end of said body is mounted, where said stand comprises a substantially flat base projecting radially relative to said body in order to place said device stably on the floor and to signal the presence of said product on the floor. The method finally comprises the step of picking up said residue formed by said powder and said product using at least two parts detached from said base and possibly, pouring said residue into a bag previously taken out of the cylindrical body.

In a similar way, the subject matter of the present invention according to a third aspect relates to a device for absorption, signaling and picking up as it was previously described for absorbing and signaling the presence on a floor of a potentially hazardous product and for picking it up.

Thus, the subject of the present invention, by the various functional and structural aspects thereof described above constitutes a practical and easy to use tool remedying all the disadvantages encountered up to now in the matter of security and prevention, in particular in home-improvement or gardening stores, for absorbing, neutralizing, signaling and picking up the presence of the hazardous product on the floor.

BRIEF DESCRIPTION OF THE FIGURES

Other characteristics and advantages of the present invention will be seen from the following description with reference to FIGS. 1 to 3 attached which show it in an embodiment without any limiting nature and in which.

DETAILED DESCRIPTION

Figure 1A:
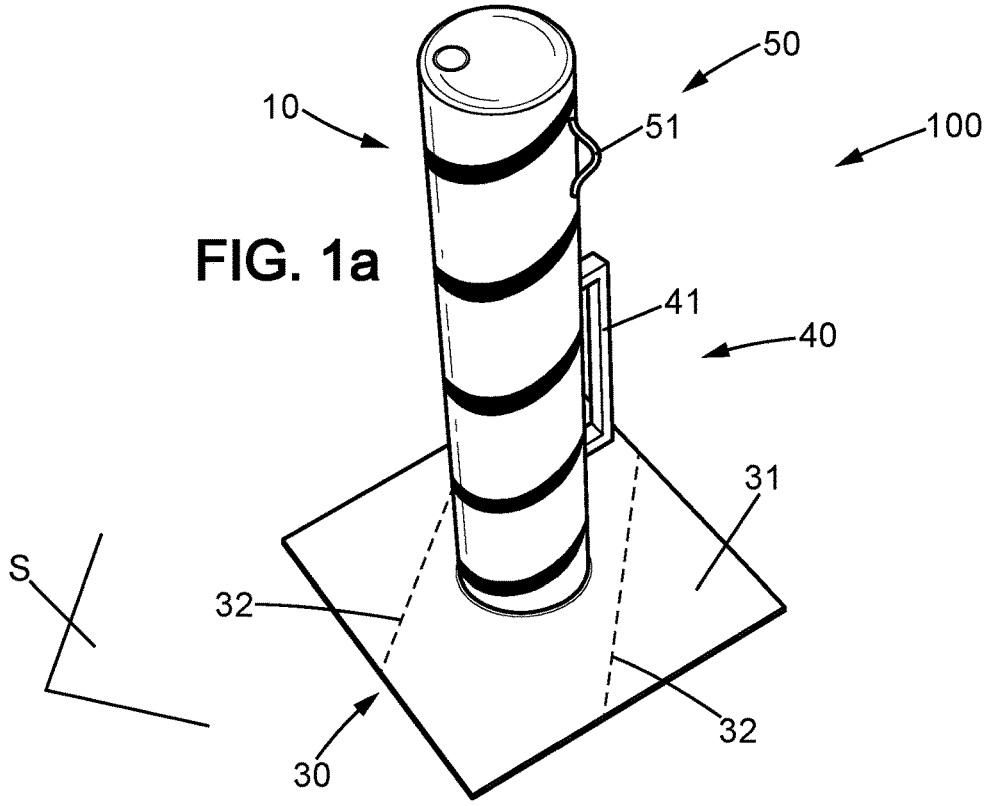
FIG. 1*a* schematically shows a perspective view of a device for absorption, neutralization, signaling and picking up a potentially hazardous product according to an embodiment of the present invention.

A device for absorption, neutralization, signaling and picking up of a potentially hazardous product according to a sample implementation of the present invention is now going to be described in the following referring jointly to FIGS. 1 to 3.

Recall that one of the objects of the present invention is to provide a practical tool with which to at once absorb, neutralize, signal and pick up a potentially hazardous product.

The example described here principally relates to an application in a home improvement store.

It will be understood here that it involves a sample application among others and obviously the present invention could find other applications and other fields like hazard prevention in particular chemical in industrial environment or in a public place like for example a train or Metro station.

In the example described here, there is a situation in which a paint can has accidentally fallen in an aisle of the home improvement store.

Paint P spilled on the floor S of the aisle of the store constitutes a hazard both for the customers and for the staff of the store.

In fact it is possible to slide when walking on the paint P spilled on the floor S. Here it essentially represents a bodily hazard, even if ingestion of paint can also represent a health hazard.

Here the paint P is therefore seen as a potentially hazardous product in the meaning of the present invention.

The person responsible for safety, here for example the department head, is therefore immediately notified.

As reviewed above the objective for the department head is, as a first step, to absorb the paint P on the floor S, then signal to third parties the presence of this paint P on the floor S and finally to pick up the product.

The object of the absorption phase is to avoid a bodily accident if, for example, a customer or staff member walks on the paint on the floor and slips.

Here absorption consists in bringing the paint (liquid) to a solid or granular state.

Conventionally, sawdust is used, which is not very effective and not very practical for the reasons previously raised.

A powder 20 of the "POLYCAPTOR®" type sold by the Prevor company is therefore preferably provided for the absorption of this paint P.

Such a powder 20 is intended to combat any type of accidental spreading of liquid product. Upon contact with the potentially hazardous products such as paint, the composition of this powder 20 allows it to absorb any type of product by using a minimum quantity and at a lower cost than that of absorbent powders currently on the market.

Further, the composition of this powder 20 is not hazardous (e.g. nontoxic, nonirritating, hypoallergenic and non-ecotoxic), unlike some other products currently sold.

This "POLYCAPTOR®" type product is therefore particularly appropriate for the use that we want to make of it in the sample application.

Obviously, the person skilled in the art will understand here that the use of other types of absorbing powder could be considered in the context of the present invention.

As another example one can anticipate another situation in which the contents of a bottle of hydrochloric acid is spilled on the floor.

Such bottles are generally solid in home improvement stores, in particular for unclogging drains.

It is understood here that hydrochloric acid constitutes here a potentially hazardous product P in the meaning of the present invention.

There is in fact a health hazard which could occur if, for example, the acid P came into contact with the skin of a customer.

One can also imagine an accidental inhalation or ingestion of this acid P.

In this specific case, the department head therefore needs to absorb and neutralize potential harmful and toxic chemical effects of the acid P on the floor S.

Here, neutralize is understood to mean limiting or even eliminating all the potentially hazardous effects or reactions of the product. In particular, for an acid, it involves returning the pH to a value included between 5 and 10, even the value of the pH to 7.

Here, for absorbing and neutralizing the acid P on the floor, the use of a powder 20 of "TRIVOREX®" type sold by the PREVOR company is therefore preferably intended.

Obviously, the person skilled in the art will understand here that the use of other types of absorbing and neutralizing powder could be considered in the context of the present invention.

This powder 20 mixed with the product on which it is poured forms a solid residue.

To spread this powder 20 on the product P (paint or acid) in order to absorb and potentially neutralize this product and for finally picking up the residue, a device 100 is provided in the scope of the present invention.

Figure 1B:
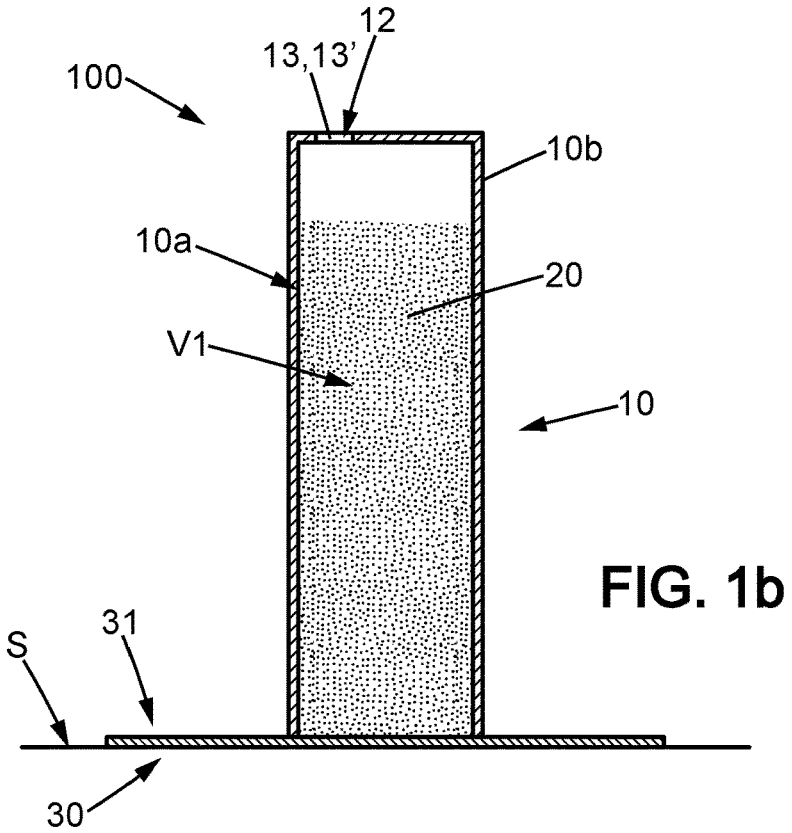
FIG. 1*b* schematically shows a section view of a device for absorption, neutralization, signaling and picking up according to FIG. 1*a;*

As shown in FIGS. 1*a* and 1*b*, the device 100 according to the present invention comprises a slender hollow body 10 with cylindrical shape mounted on a stand 30. The stand 30 and the body 10 together form a signaling marker.

In this example, the inner walls 10*a* of the cylinder define a storage volume V1 in which to store the powder 20.

The cylinder could be made of cardboard. The cylinder may of course be of any other material, in particular a polymer such as polyethylene. The inner walls 10*a* of the cylinder can be covered with a protective film to separate the powder from the rest.

This film can also be made fire resistant.

In the context of use with "POLYCAPTOR®" or "TRIVOREX®" such a film is not necessary.

In the example described here and shown in FIGS. 1*a* and 1*b*, this volume V1 opens out near the top end of the body 10 when in vertical position, therefore opposite the stand 30 through an opening 12 closed by closure means such as for example a removable cap 13 or detachable seal 13'.

In practice, the department head, responsible for securing the area, grabs the device 100 and removes the cap 13 or breaks the seal 13' to clear the opening 12. The opening 12 is equipped with a pouring spout to make it easier to pour the powder 20 on said product P by gravity. Such a spout is helpful for properly controlling the amount of the powder poured onto the product.

By pouring the powder 20 by gravity on the product P, it can nearly immediately be absorbed and possibly neutralized. A solid residue is then formed and the residue can be recovered and thrown out.

Figure 2A:
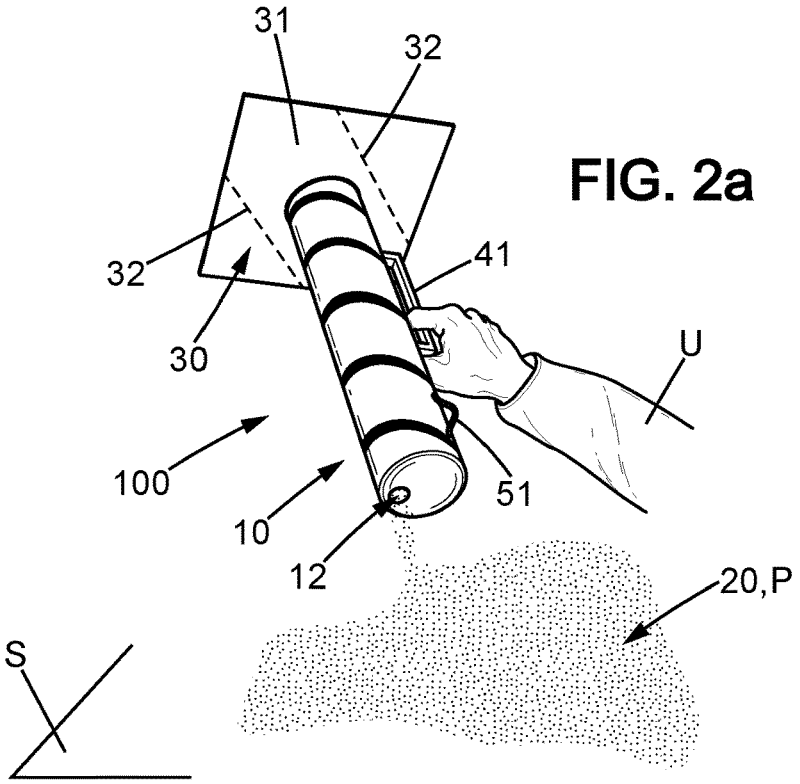
FIGS. 2*a*, 2*b*, 2*c*, 2*d* and 2*e* schematically show the use of a device for absorption, neutralization, signaling and picking up according to FIG. 1.

In the example described here, the department head holds the device 100 by gripping means 40 such as a handgrip 41 which is provided on the outer wall 10*b* of the cylinder (see FIG. 2*a*).

Figure 2B:
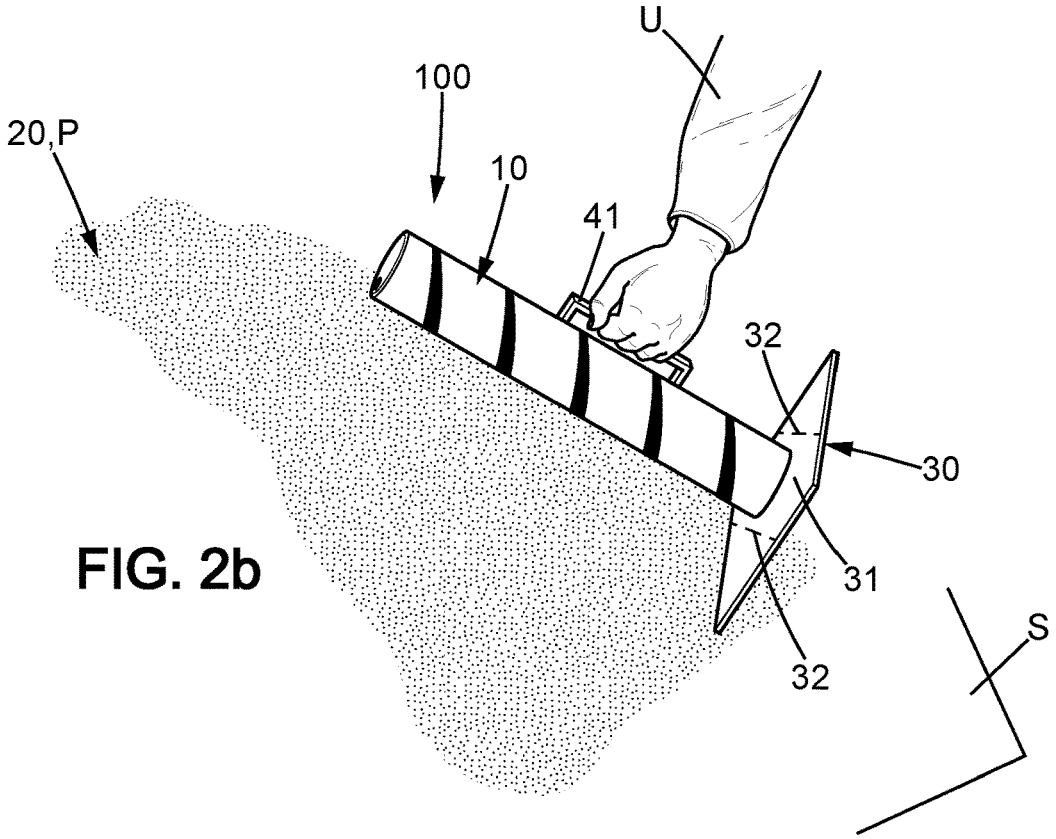
Figure 2C:
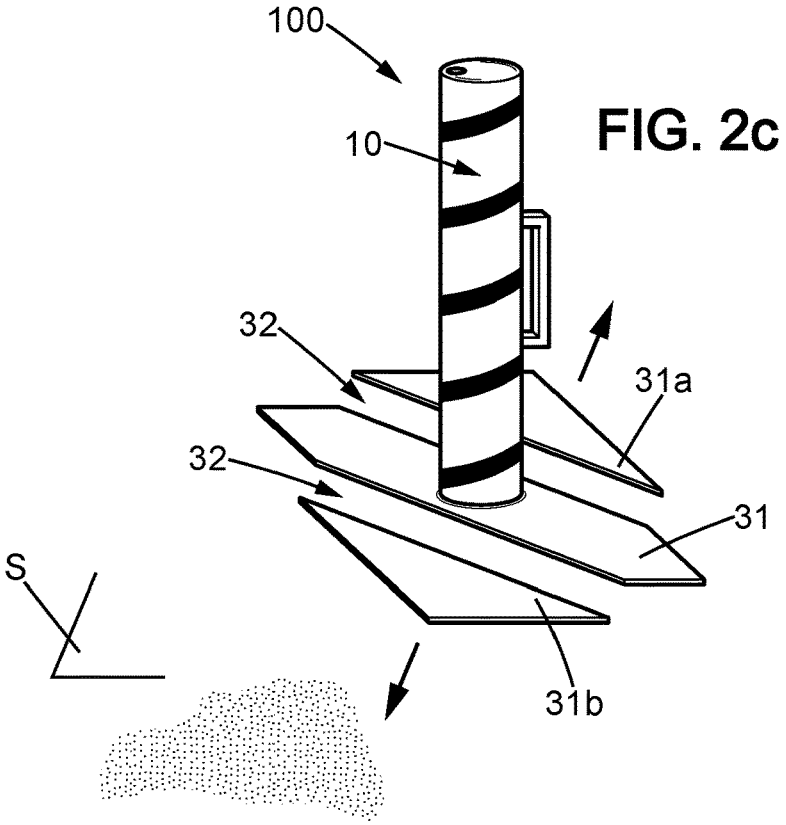

This handle 41 makes it easier to hold said device (100) in particular when pouring the powder 20 by gravity onto the product P on the floor S (see FIG. 2*b*). The outside wall 10*b* of the hollow body 10 may comprise signage parts suited to signaling the presence of the product P on the floor S.

The base 31 of the stand is substantially flat and projects radially from said body 10 in order to be able to place said device 100 on the floor stably. The slender hollow body is substantially cylindrical and the radial extension of the base 31 is larger than the diameter of the cylinder such that the device 100 is stable when placed on the floor.

Figure 2D:
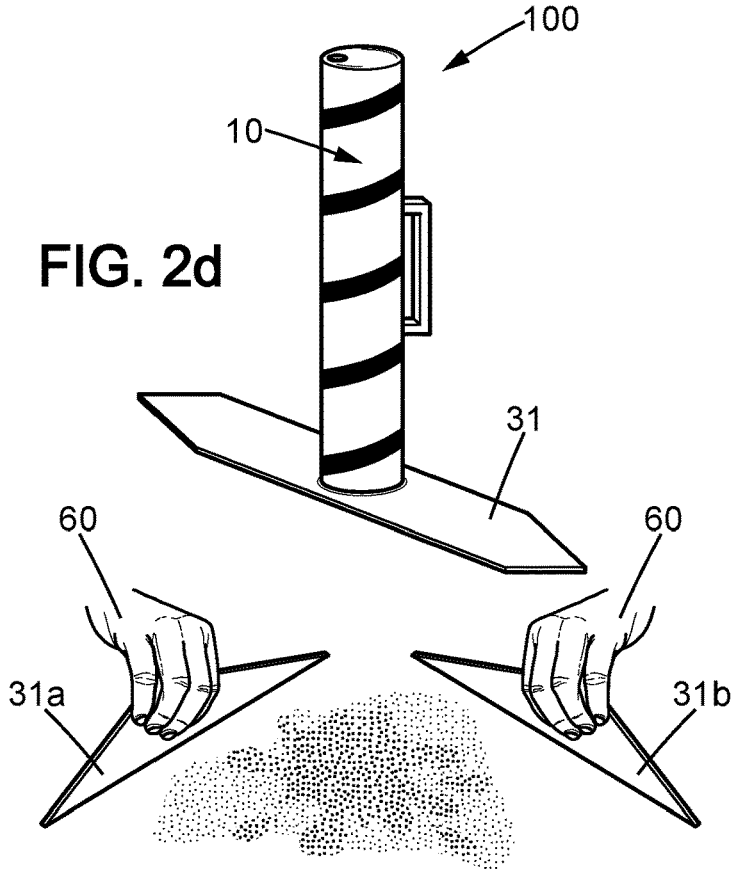
Figure 2E:
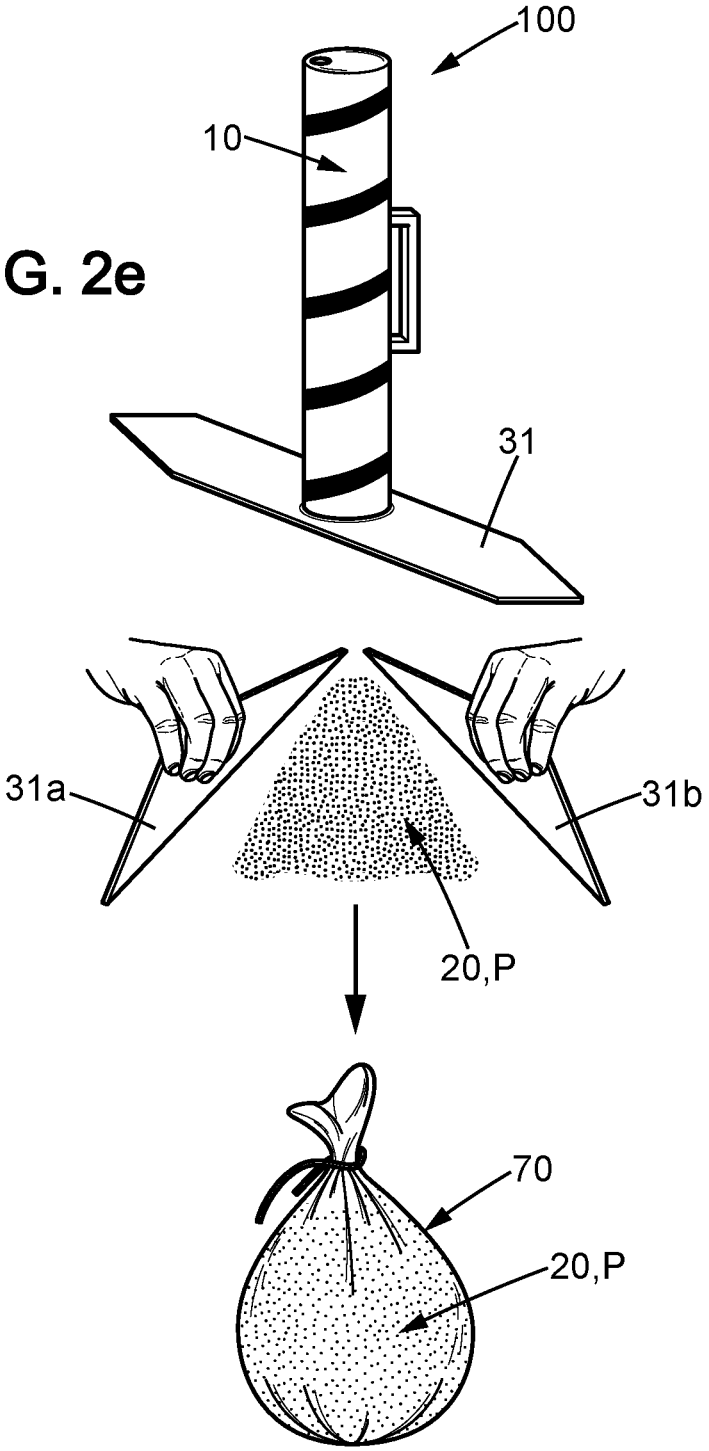

The base 31 comprises at least two detachable parts 31*a* and 31*b* (FIG. 2*c*) which can be used for picking up the residue formed by said powder and said product (FIG. 2*d*). The geometry and sizes of the detachable parts 31*a*, 31*b*, relative to the rest of the base 31 is such that after removal of the detachable parts 31*a* and 31*b*, the signaling marker still remains stable on the floor. Each detachable part typically has a surface area greater than one third, preferably one quarter of the surface area of the base 31.

It is understood from the description that the base could comprise a larger number of detachable parts so long as the marker remains stable after detaching the detachable parts.

Precuts 32 make it easier to separate a detachable part 31*a*, 31*b* from the base 31.

In a preferred embodiment, the base 31 has a substantially square shape as shown in FIG. 1*a*. The base 31 for example comprises two triangular-shaped detachable parts 31*a* and 31*b* which have similar dimensions. After detachment of the detachable parts 31*a* and 31*b*, the base 31 has a shape in the base plane substantially longitudinal which provides for the stability thereof.

When the powder is poured on the paint P, the department head just needs to place the signaling marker beside the paint P and pick up the residue with the scoops thus formed.

The base 31 and possibly the hollow body 10 are formed of polymer, preferably a recyclable polymer. The recyclable polymer is polyethylene or polypropylene, for example. Thus, the base 31 will not be damaged by the spilt liquid product.

The body 10 and the stand 30 are structurally independent of each other, and said body 10 and said stand 30 each comprise means of securely connecting able to engage together for assembling securely said body 10 and said stand 30. This assembly can be done for example by nesting the body 10 into said stand.

It is thus easy to store the device 100 for minimizing its bulk: the body 10 and the stand 30 are two separate pieces which nest one in the other by the means for secure connection described above.

The storage volume V1 can also contain a bag 70. The storage volume can also contain gloves 60.

In this case, the bag and the gloves are taken out of the storage volume. The user puts the gloves on. The residue 20, P is picked by the user and poured in the bag 70 which is then thrown out.

Means of anchoring 50 can also be provided, such as hooks 51 arranged on the top wall 10*b* of the body 10 of each device 100.

Figure 3:
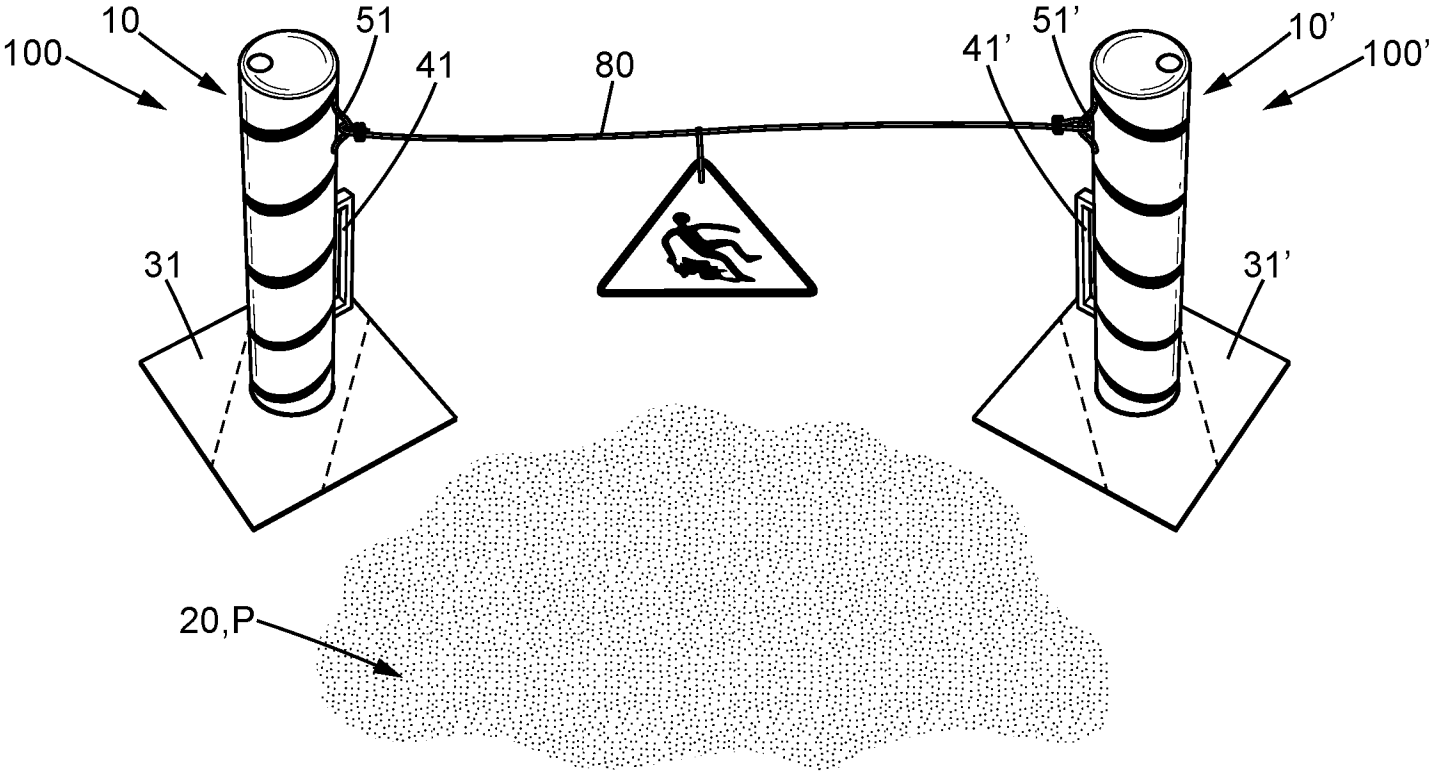
FIG. 3 schematically shows several devices for absorption, signaling and picking up connected to each other by a safety rope for marking off a potentially hazardous area.

The department head can then physically connect several devices 100 to each other using a cord 60 in order to mark off the floor S in a danger zone (FIG. 3).

Thus, the device 100, the subject of the invention, is seen as an indispensable tool for providing for safety and hazard prevention in stores.

It addresses both the standards for safety and prevention and the requirements of people involved in providing that safety and prevention: practical, simple to use, three-in-one object, small size, etc.

Considering the qualities of this device 100, it is easily understood that it will find other advantageous applications such as for example use in an industrial context for providing security and prevention in an industry in which the employees regularly handle hazardous products (e.g. automobile industry, chemical industry, steel industry, etc.).

Other applications can also be conceived, such as for example in physician and veterinary offices for absorbing and signaling liquids on the floor after for example urine leaks.

It should be observed that this detailed description covers one specific sample embodiment of the present invention, but in no case does this description put any limiting nature whatsoever on the invention; quite the opposite, its purpose is to dispel any possible imprecision or any misinterpretation of the following claims.

The invention claimed is:

1. A device for absorbing, signaling and picking up a product on a floor, said device comprising:

a slender hollow body whose inner walls define an enclosed storage volume in which is stored a powder able to absorb said product, where said enclosed storage volume comprises an opening for pouring said powder by gravity; and a stand on which one end of said body is mounted for forming a signaling marker, where said stand comprises a substantially flat base projecting radially relative to said body in order to place said device stably on the floor, wherein the base comprises at least two detachable parts which can be used for picking up a residue formed by said powder and said product.

2. The device for absorbing, signaling and picking up according to claim 1, wherein the base of the stand is formed of a polymer.

3. The device for absorbing, signaling and picking up according to claim 1, wherein the enclosed storage volume also contains a bag suitable for receiving the residue formed by said powder and said product and/or a pair of gloves.

4. The device for absorbing, signaling and picking up according to claim 1, wherein the base has a precut at each junction between a detachable part of the base and the base, suited for making the detachment of the detachable part from the base easier.

5. The device for absorbing, signaling and picking up according to claim 1, wherein the slender hollow body is substantially cylindrical and the radial extension of the base is larger than the diameter of the cylinder.

6. The device for absorbing, signaling and picking up according to claim 1, wherein each detachable part has a surface area greater than a third, preferably greater than a quarter of the surface area of the base.

7. A method for absorbing, signaling and picking up said product which is a potentially hazardous product on the floor using the device according to claim 1, comprising:

pouring said powder by gravity through said opening of said slender hollow body whose inner walls define said enclosed storage volume in which is stored said powder able to absorb said product when said powder enters into contact with said product;

signaling of said product, using the signaling marker formed by said stand on which the lower end of said body is mounted, where said stand comprises said substantially flat base projecting radially relative to said body in order to place said device stably on the floor and to signal the presence of said product on the floor;

picking up said residue formed by said powder and said product using at least two detached parts from said base; and optionally, pouring said residue into a bag previously taken out of the slender hollow body, wherein the slender hollow body is substantially cylindrical and the radial extension of the base is larger than the diameter of the cylinder.

8. A method for absorbing and signaling the presence on the floor of said product which is a potentially hazardous product using at least one device according to claim 1, comprising:

pouring said powder by gravity through said opening of said slender hollow body whose inner walls define said enclosed storage volume in which is stored the powder able to absorb said product when said powder enters into contact with said product; and signaling of said product, using the signaling marker formed by said stand on which the lower end of said body is mounted, where said stand comprises a substantially flat base projecting radially relative to said body in order to place said device stably on the floor and to signal the presence of said product on the floor.

9. The device for absorbing, signaling and picking up according to claim 1, wherein the base has a substantially square shape.

10. The device for absorbing, signaling and picking up according to claim 9, wherein each detachable part has a substantially triangular shape.

* * * * *